US011402174B2

(12) United States Patent
Angle

(10) Patent No.: US 11,402,174 B2
(45) Date of Patent: Aug. 2, 2022

(54) SMALL ARMS STABILIZATION SYSTEM

(71) Applicant: MAJR Mechatronics LLC, Sebring, FL (US)

(72) Inventor: Matthew G. Angle, Teton Village, WY (US)

(73) Assignee: MAJR MECHATRONICS LLC, Sebring, FL (US)

( * ) Notice: Subject to any disclaimer, the term of this patent is extended or adjusted under 35 U.S.C. 154(b) by 133 days.

(21) Appl. No.: 17/029,012

(22) Filed: Sep. 22, 2020

(65) Prior Publication Data

US 2021/0207921 A1 Jul. 8, 2021

Related U.S. Application Data

(60) Continuation of application No. 16/548,909, filed on Aug. 23, 2019, now Pat. No. 10,801,809, which is a continuation of application No. 15/726,623, filed on Oct. 6, 2017, now Pat. No. 10,429,149, which is a division of application No. 15/092,331, filed on Apr. 6, 2016, now Pat. No. 9,784,529.

(60) Provisional application No. 62/143,892, filed on Apr. 7, 2015.

(51) Int. Cl.
*F41C 27/22* (2006.01)
*F41C 23/16* (2006.01)

(52) U.S. Cl.
CPC ..... *F41C 27/22* (2013.01); *F41C 23/16* (2013.01)

(58) Field of Classification Search
CPC ..... F41C 27/22; F41C 23/16
USPC ..... 42/71.01, 90
See application file for complete search history.

(56) References Cited

U.S. PATENT DOCUMENTS

| | | | | |
|---|---|---|---|---|
| 5,520,085 | A * | 5/1996 | Ng | F41G 3/323 89/14.05 |
| 5,834,677 | A * | 11/1998 | Muller | F41A 27/30 89/41.17 |
| 5,974,940 | A * | 11/1999 | Madni | F41A 21/48 42/119 |
| 6,782,789 | B2 | 8/2004 | McNulty, Jr. | |
| 6,901,691 | B1 | 6/2005 | Little | |
| 7,478,496 | B2 | 1/2009 | Bender | |
| 7,563,097 | B2 | 7/2009 | Lavigna | |
| 8,590,201 | B2 | 11/2013 | Brixius | |
| 8,601,736 | B2 * | 12/2013 | Andersson | F41G 3/12 42/75.03 |
| 8,752,321 | B2 | 6/2014 | Burress, Jr. | |
| 9,010,002 | B2 * | 4/2015 | Popa-Simil | F41G 3/12 42/1.06 |
| 2004/0045207 | A1 * | 3/2004 | McNulty, Jr. | F41G 1/34 42/40 |
| 2005/0115140 | A1 * | 6/2005 | Little | F41C 23/04 42/118 |

(Continued)

*Primary Examiner* — Samir Abdosh
(74) *Attorney, Agent, or Firm* — Butzel Long; Donald J. Lecher

(57) ABSTRACT

A self-stabilizing small arm having a barrel assembly rigidly connected to a stock assembly. The small arm includes at least one shooter interface surface and a stabilization assembly controlling the relative position of the shooter interface surface and the barrel assembly or stock assembly. The stabilization assembly includes (i) at least one movement sensor; (ii) at least one actuator; and (iii) a controller using signals from the movement sensor to operate the actuator in order to compensate for unintended movement of the small arm.

21 Claims, 12 Drawing Sheets

(56) References Cited

U.S. PATENT DOCUMENTS

| | | | | |
|---|---|---|---|---|
| 2005/0188827 | A1* | 9/2005 | McNulty, Jr. | F41B 15/04 89/1.11 |
| 2006/0194173 | A1* | 8/2006 | Lavigna | F41C 23/16 434/16 |
| 2007/0094912 | A1* | 5/2007 | Bender | F41A 23/10 42/94 |
| 2011/0185617 | A1* | 8/2011 | Brixius | F41C 23/12 42/71.01 |
| 2012/0042559 | A1* | 2/2012 | Bockmon | F41G 3/12 42/111 |
| 2013/0305580 | A1* | 11/2013 | Burress, Jr. | F41C 23/22 42/71.01 |

* cited by examiner

SMALL ARMS STABILIZATION SYSTEM

CROSS REFERENCE TO RELATED APPLICATION

This application is a continuation of application Ser. No. 16/548,909, filed on Aug. 23, 2019, which claims the benefit under 35 U.S.C. § 119(e) of application Ser. No. 15/726,623, filed on Oct. 6, 2017, and issued as U.S. Pat. No. 10,429,149 on Oct. 1, 2019, which claims the benefit under 35 U.S.C. § 119(e) of application Ser. No. 15/092,331, filed on Apr. 6, 2016, and issued as U.S. Pat. No. 9,784,529, on Oct. 10, 2017, which claims the benefit under 35 U.S.C. § 119(e) of U.S. Provisional Application Ser. No. 62/143,892 filed Apr. 7, 2015, all of which are incorporated by reference herein in their entirety.

BACKGROUND OF INVENTION

The present invention relates to aiming and stabilization systems for projectile weapons. In many embodiments, the invention relates to systems allowing an individual to more accurately aim a hand-held weapon, for example a small arm.

DETAILED DESCRIPTION OF SELECTED EMBODIMENTS

One embodiment of the invention comprises a small arm incorporating a stabilization system, in other words, a self-stabilizing small arm. "Small arm" as defined herein means any conventional or future developed firearm normally fired by an individual person, including handguns, shotguns, sporting rifles, or military rifles. Small arms may also include heavier weapons such as light machineguns (e.g., the US military's M-249 squad automatic weapon or SAW) and medium machineguns (e.g., the US military's M-60).

Figure 1:
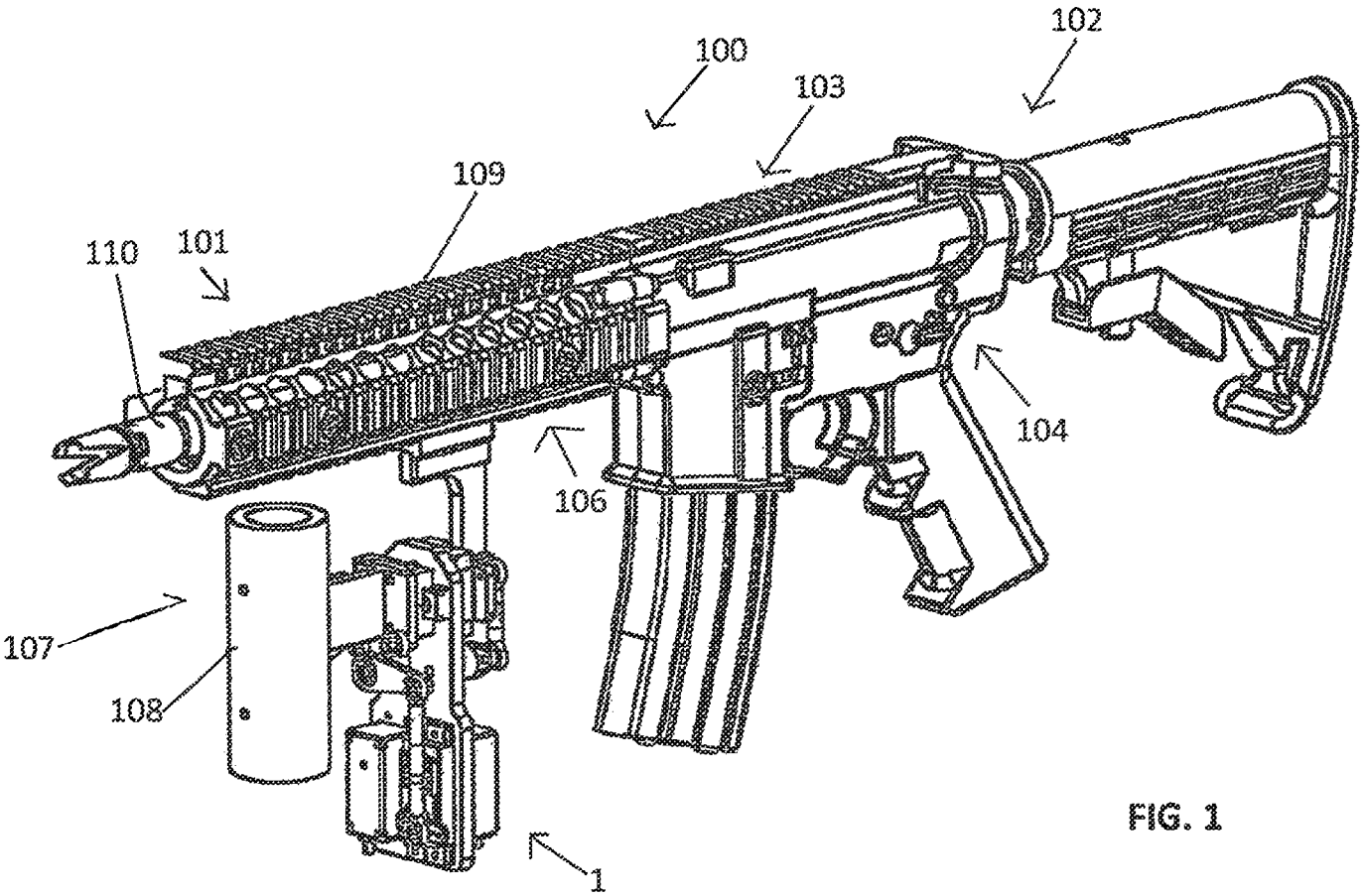
FIG. 1 illustrates one embodiment of the stabilization system mounted to an M4 type rifle.

FIG. 1 illustrates an M4 type rifle 100 with one embodiment of the stabilization system 1 incorporated therewith. "M4 type rifle" means the family of firearms that derives from US military's M16 rifle, whether in 5.56 mm caliber, 7.62 mm caliber, or other variation, either military or civilian. This rifle 100 generally comprises the stock assembly 102 and the barrel assembly 101. For purposes of the FIG. 1 embodiment, the stock assembly 102 may include the lower receiver 104 to which it is attached. Likewise, the barrel assembly 101 may be considered to include the upper receiver 103 into which the barrel 110 is threaded. The length along barrel 110 may be considered the long axis of the barrel assembly. The barrel assembly 101 further includes the hand guard 106 surrounding the barrel 110 and a series of accessory rails 109 positioned on hand guard 106. In certain prior art configurations of the rifle 100 (not shown), a vertical grip is connected to and extends from lower rails on the hand guard 106. In other prior art configurations, the hand guard 106 itself (or gripping surfaces placed on the rails) forms a horizontal forward gripping surface on the rifle. The term "fore grip" as used herein means a vertical grip extending from the hand guard, a horizontal gripping surface on the hand guard, or any other gripping surface forward of the pistol grip on lower receiver 104 (e.g., a gripping surface on the front side of the magazine well). In more traditional rifle configurations not illustrated (e.g., the M-1 Garand), a wood stock typically includes a unitary wood fore-arm extending from the main stock portion and including wood hand guards. In such configurations, the barrel assembly includes the barrel together any handguard/fore-arm and other parts forward of the magazine.

During normal use of the M4 type rifle 100 seen in FIG. 1, the upper receiver 103 and lower receiver 104 are rigidly connected by at least two pins and thus, barrel assembly 101 and stock assembly 102 are rigidly connected to one another. In other words, there can be no relative pivoting or rotation between barrel assembly 101 and stock assembly 102 (including no relative rotation between barrel assembly 101 and stock 105). The same relative rigidity applies between the stock and barrel assemblies of the traditional rifle configuration described above.

Figure 2:
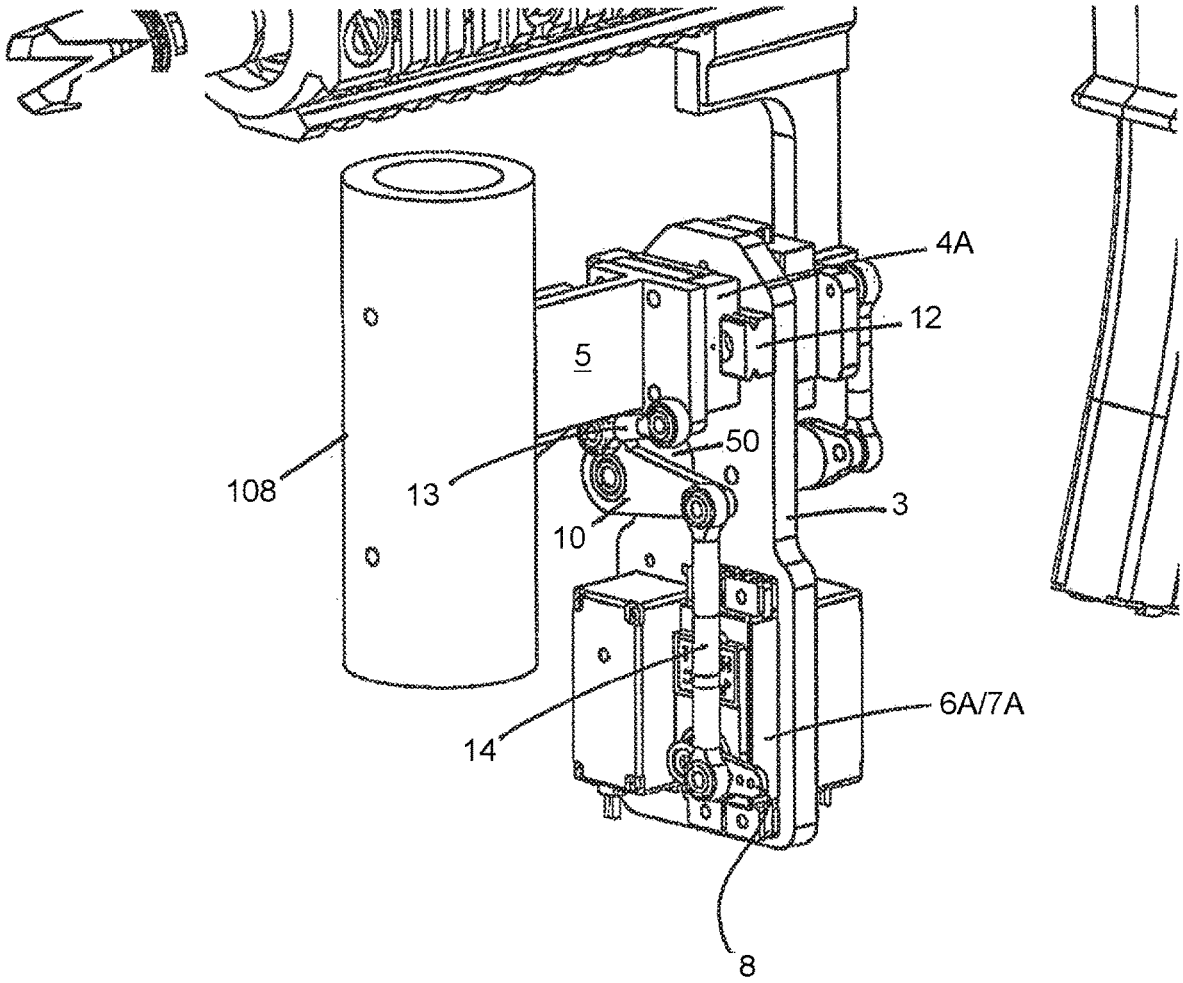
FIG. 2 illustrates a more detailed view of the stabilization system seen in FIG. 1.

FIG. 1 illustrates one type of fore-grip (vertical grip 108) connected to the barrel assembly 101 by one embodiment of stabilization assembly 1. FIG. 2 better illustrates how this embodiment of stabilization assembly 1 includes a central plate 3 onto which various components are fixed. Central plate 3 has a window into which actuators 6A (FIG. 2) and 6B (FIG. 3) are positioned. In the illustrated embodiment, actuators 6A and 6B are servo motors 7A and 7B (e.g., model no. HITEC HS-7966 or HITEC HS-8315, available from HITEC RCD USA, Inc. of Poway, Calif.), but could be other conventional or future developed actuator types. For example, as explained in more detail below, FIG. 9 illustrates an alternative actuator system formed of flexures and ball screw motors.

Returning to FIG. 2, still further alternative actuators could include lead screws, ball screws, bell cranks and linkages, cam disks, any sort of rotary to linear actuator, a linear electric motor, or bias springs. Also attached to central plate 3 is the horizontal bearing rail 12 upon which linear bearing 4A is able to slide right or left (i.e., windage correction) relative to central plate 3. The vertical grip attachment member 5 connects linear bearing 4A to the vertical grip 108.

FIG. 2 illustrates how the bell crank 10 is pinned to central plat 3 with spacer 50 offsetting bell crank 10 form central plate 3. Although somewhat hidden from view, one end of short linkage 13 is pinned to the upstanding leg of bell crank 10 and the other end of short link 13 is pinned to grip attachment member 5. The opposing end of bell crank 10 is pinned to a first end of long link 14 and the second end of long link 14 is pinned to straight crank 8, which is in turn connected to the torque transferring shaft of servo motor 7A. Thus, it can be envisioned how torque from servo motor 7A is converted by linages 13/14 and bell crank 10 into a linear left/right force acting on linear bearing 4A to cause left/right movement of linear bearing 4A on bearing rail 12. The left/right motion of linear bearing 4A translates to left/right movement of vertical grip 108 relative to central plate 3 (and thus, barrel assembly 101).

Figure 3:
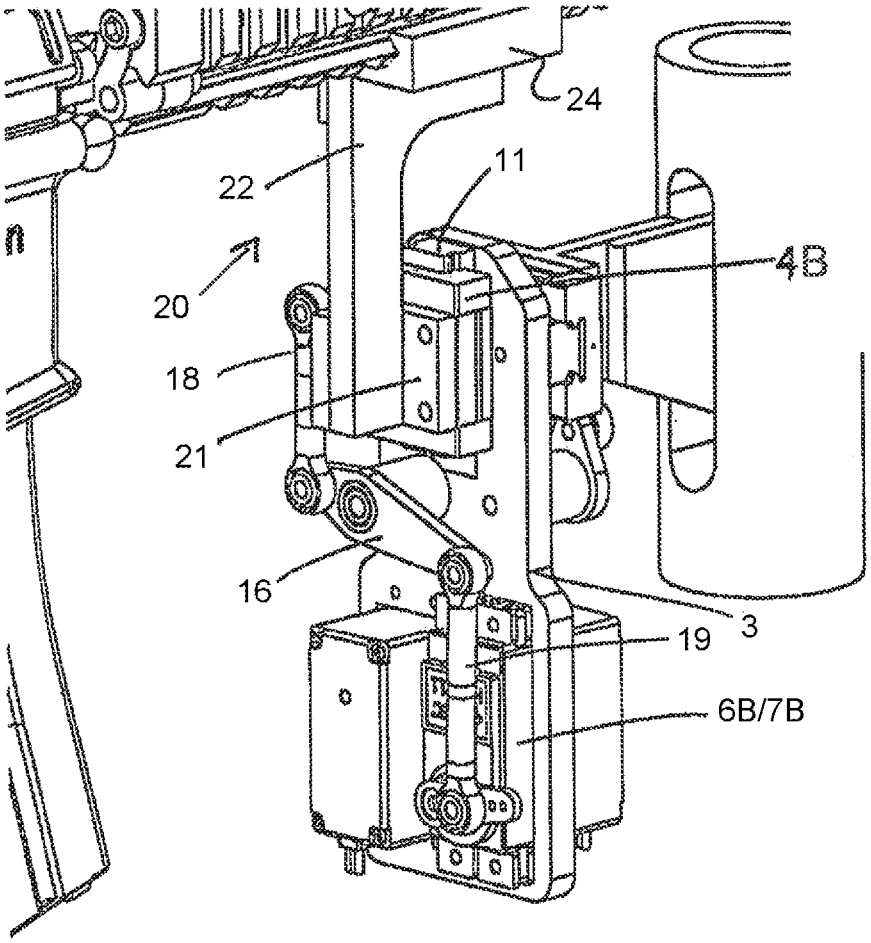
FIG. 3 illustrates a rotated view of the stabilization system shown in FIG. 2.
Figure 4:
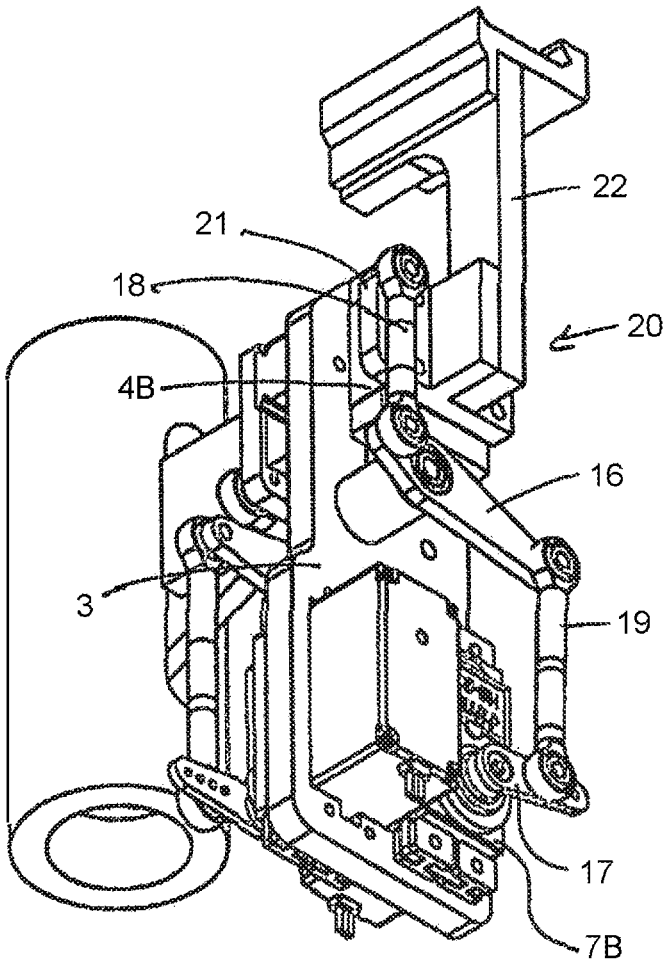
FIG. 4 illustrates another perspective view of the FIG. 1 stabilization system.

FIG. 3 illustrates a similar configuration on the reverse side of central plate 3. Here, the linear bearing 4B is able to move up and down relative to central plate 3 (i.e., elevation correction) on a vertical bearing rail 11. The bearing connector 21 is attached to linear bearing 4B and bearing connector 21 is in turn connected to vertical brace 22, which forms the support structure for hand guard connector 24. Bearing connector 21, vertical brace 22, and hand guard connector 24 form one embodiment of the hand guard connector assembly 20. In the FIG. 1 embodiment, hand guard connector 24 is connected to the lower rail on hand guard 106. FIG. 4 best shows how short link 18 connects between bearing connector 21 and straight crank 16, while long link 19 connects between the opposing end of straight crank 16 and crank 17 attached to servo motor 7B. Thus, it can be envisioned how torque from servo motor 7B is converted to linear force acting in an up/down direction to move bearing connector 21 (and hence hand guard connector assembly 20) relative to central plate 3.

Figure 5:
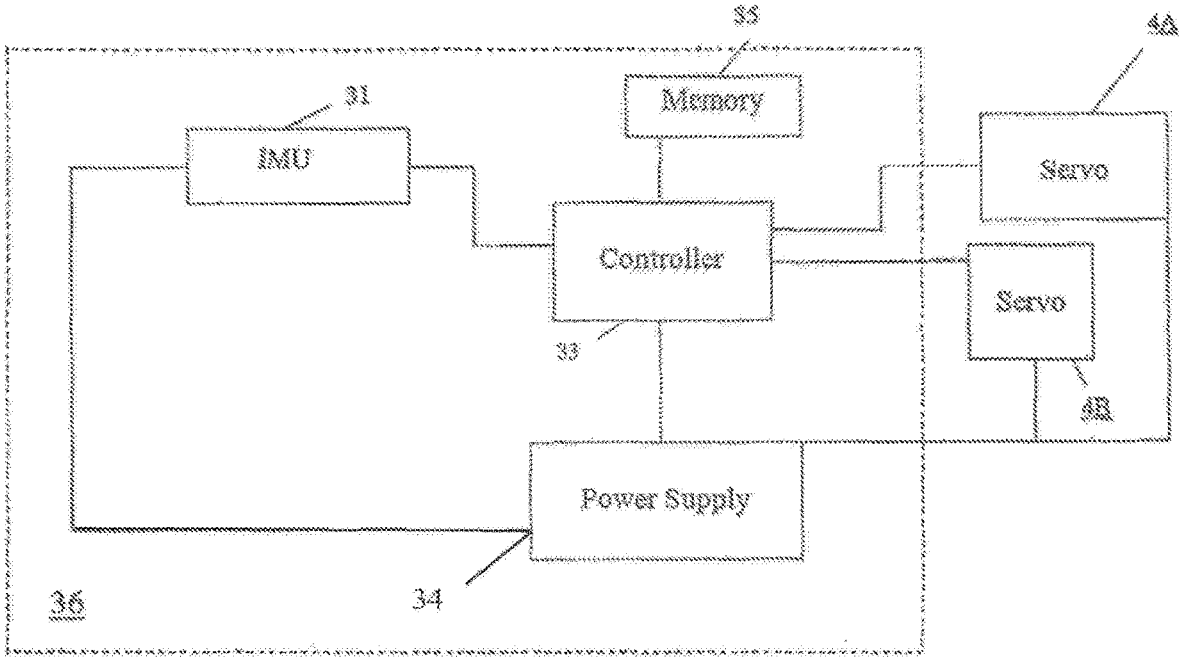
FIG. 5 illustrates one embodiment of the control electronics for the stabilization system.

Control of the stabilization system may be accomplished by any conventional or future developed control system which senses movement of the fore grip and directs the actuators to counter such movement, thus stabilizing barrel assembly 101 independently of the fore grip movement. FIG. 5 illustrates one example of a control system utilizing inertial measurement unit (IMU) 31. In one embodiment, the IMU is a device containing three accelerometers and three gyroscopes where the accelerometers measure inertial acceleration and the gyroscopes measure rotational position. The IMU will sense movement in both the right/left direction (windage) and the up/down direction (elevation). The IMU may be mounted on circuit board 36 together with other control components such as processor/controller 33, power supply 34, and memory 35. Controller 33 will receive position change data from the IMU, calculate correction information, and command the servo motors 4A and 4B to make the necessary corrective rotation. As one nonlimiting example, controller 33 may be a dsPIC33FJ processor available from Microchip Technology Inc. of Chandler, Ariz., the IMU may be a MPU-6000s available from InvenSense, Inc. of San Jose, Calif., the power supply may be a MCP1825 power regulator and the memory chip may be a 25LC512, both available from Microchip Technology Inc. In the FIG. 3 embodiment, circuit board 36 may be positioned on vertical brace 22 with the appropriate protective housing. Naturally, the actual location of circuit board 36 is not critical and could be mounted in any convenient location and orientation.

Figure 6:
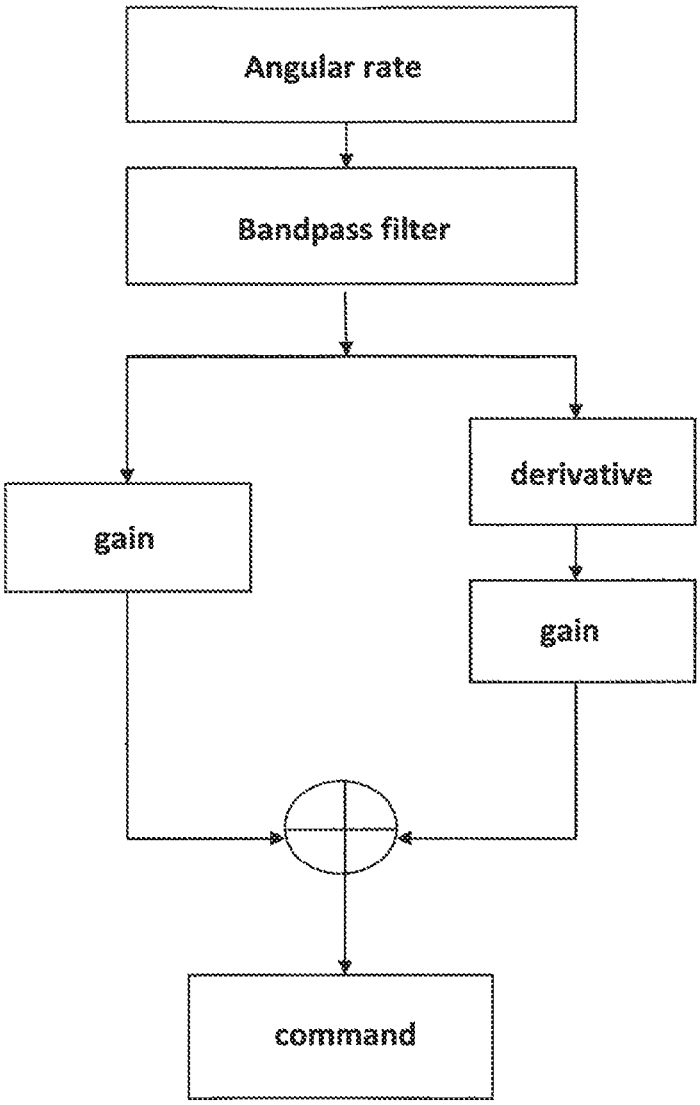
FIG. 6 illustrates one embodiment of a compensation algorithm.

One system control algorithm is illustrated in FIG. 6. FIG. 6 suggests a proportional-derivative control algorithm. The IMU will provide the angular rate of change of the structure on which circuit board 36 is mounted. The band pass filter will operate to eliminate frequencies outside the range typically associated with involuntary muscle movement occurring while a shooter is attempting to maintain the sites on the target, e.g., outside of about 0.1 to about 10 Hz, or more preferably, about 0.5 to about 5 Hz. The signal is used to generate a proportional gain term and a derivative gain term. These two terms are summed and the resultant value used as command signals to the servos. The band pass filter range given above is merely one example and ranges outside 0.1 to 10 Hz or narrower than 0.5 to 5 Hz may be employed depending on the particular requirements of the weapon system, the individual shooter, etc.

Figure 7A:
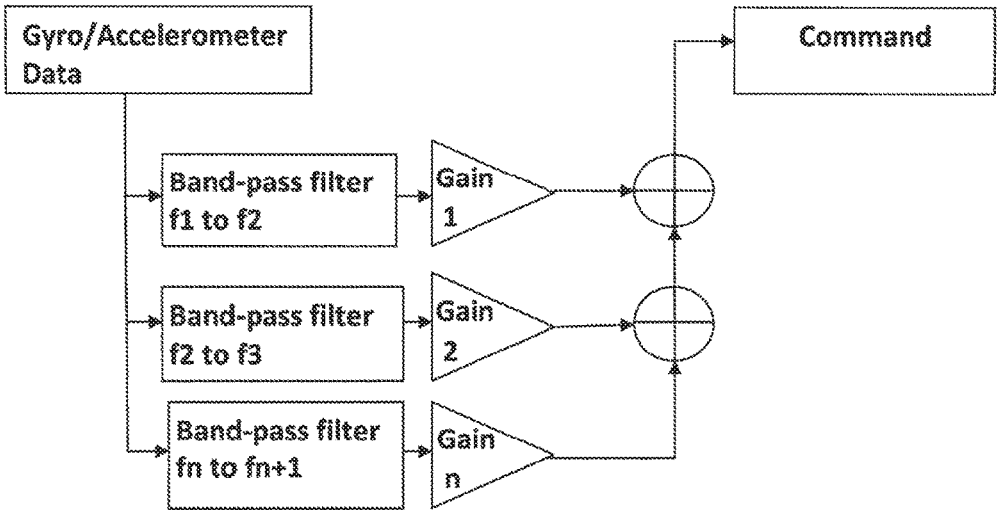
FIG. 7A illustrates an alternative compensation algorithm.

FIG. 7A illustrates a similar control strategy as seen in FIG. 6, but with more sophisticated filtering on the inputs from the gyros and/or accelerometers. This embodiment may employ a single, but more preferably, a plurality of digital band-pass filters to isolate certain frequency ranges and apply a specific gain to each frequency range. This approach allows greater flexibility in dealing with the interaction of the human hand-eye feedback loop and the mechanical compensation loop. In a preferred embodiment, this approach allows the stabilization system to lessen input within a frequency range that is controllable by the human, e.g., intentional aiming of a rifle, while increasing input the in human-uncontrollable frequency ranges, e.g., unintentional shaking when attempting to hold the aim steady. In the range where the human is capable of controlling motion, this approach still helps to further dampen vibration, but the input or control authority is necessarily less than in the human-uncontrollable frequency ranges in order to avoid confusing the hand-eye neural feedback loop.

FIG. 7A suggests how movement data in the most common human-uncontrollable frequency range ($f_1$ to $f_2$) would be subject to a first (highest) gain, movement data in a more ambiguous frequency range ($f_2$ to $f_3$ which may or may not represent unintentional movement) subject to a second (medium) gain, while movement data in frequency ranges likely to be intentional aiming movement ($f_n$ to $f_{n+1}$) is subject to lower gains. In one nonlimiting embodiment, the common human-uncontrollable frequency range ($f_1$ to $f_2$) may be about 0.1 to 5 Hertz, and more preferably, about 0.5 and 3 Hertz. The intentional aiming movement frequency range ($f_n$ to $f_{n+1}$) may be about 0 to 0.5 Hertz. However, these movement frequency parameters may vary considerable from individual to individual or based upon the physical/emotional stress factors of any given shooter's environment. Likewise, it may not always be the case that a higher gain is applied to perceived uncontrollable movement as opposed to perceived intentional aiming movement.

Figure 7B:
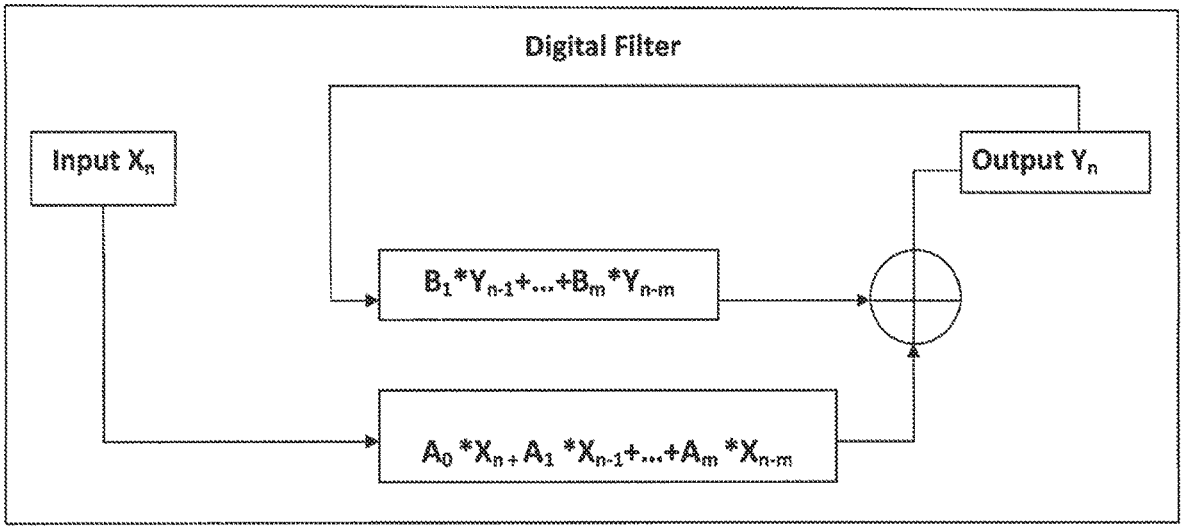
FIG. 7B illustrates one embodiment of a digital filter.

In a preferred embodiment, the digital filters suggested in FIG. 7A are Infinite-Impulse Response filters, meaning that the filters are recursive. More specifically, the filters may be modeled as seen in FIG. 7B which suggests how outputs are composed of the input and previous inputs as well as previous outputs. A number of previous inputs and outputs are considered to the order of the filter. Filter orders ("m") are most often less than ten. Gains on each previous input or output are determined to create specific gain patterns in frequency space. Common methods of determining the coefficients "A" and "B" include Butterworth, Chebyshev, and Elliptical filters.

FIG. 7A indicates that the appropriately filtered and amplified signals are summed to form the command signal (s). In the embodiment of FIGS. 1-5, the servos expect a position command from the controller 33. The servos have a controller within them that attempts to minimize response time and maximize position accuracy. Therefore, the controller 33 takes an angular rate and outputs a scaled command to cancel the angular rate on that particular axis. To do this with a servo that has its own internal control loop, the angular rate produced by the control block may be multiplied by the inverse of the control loop frequency (the time between commands) and added to the previous position command to create a new position command and effectively control the velocity of the servo. Different servos have different internal control loop parameters, which will necessitate different control gains in the compensator control loop. In a dedicated implementation, without off-the-shelf components, the two control loops would be combined into one, and the servo (rotary or linear) would be commanded with a velocity command. A position loop around the actuator would keep it in the center of its range despite external biases.

In certain embodiments, the command signals may be run through a Proportional-Integral-Derivative (PID) controller with separate gains on each component. In other words, where the PID controller is represented by:

$$u(t) = MV(t) = K_p e(t) + K_i \int_0^t e(\tau)d\tau + K_d \frac{de(t)}{dt}$$

separate gains may be applied to the separate components of the proportional gain (Kp), the integral gain (Ki), and the derivative gain (Kd).

Figure 8:
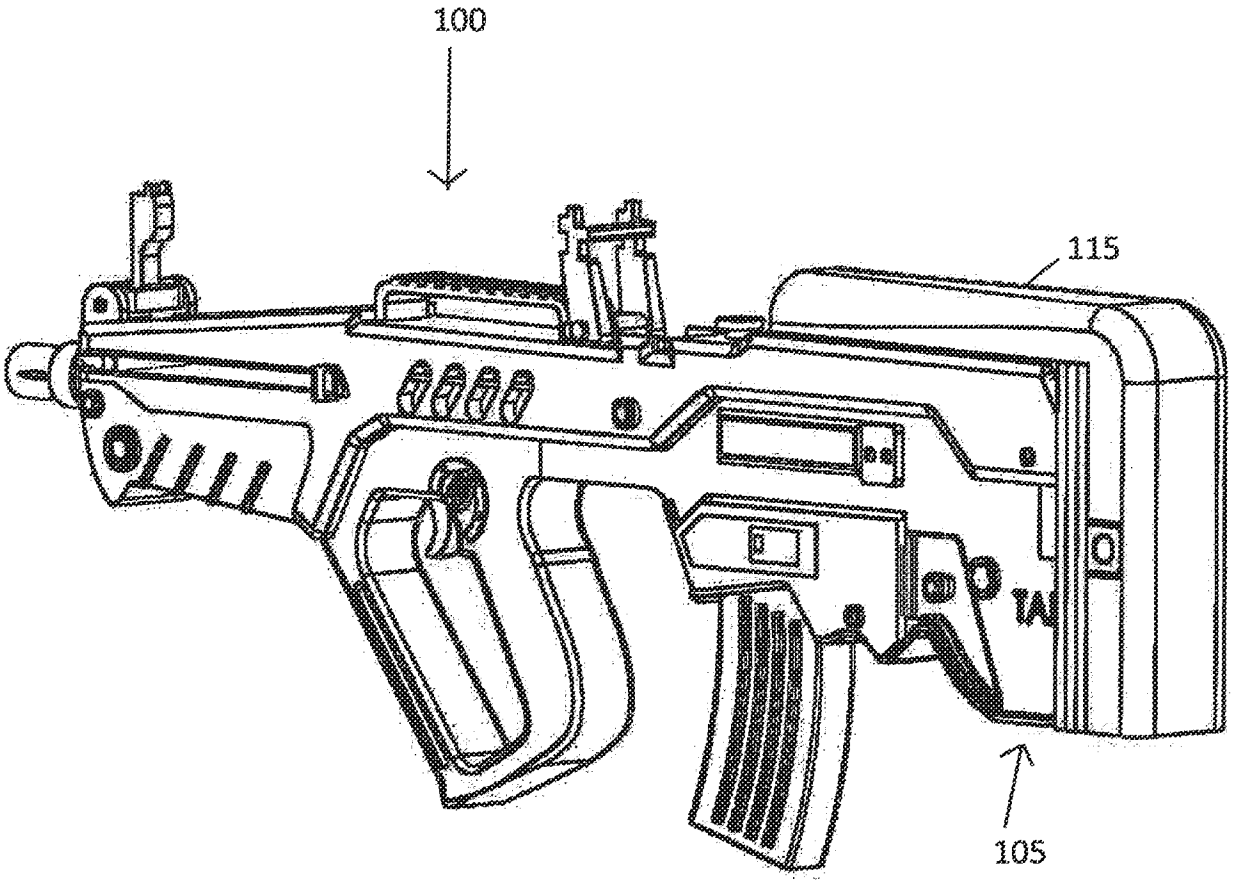
FIG. 8 illustrates another embodiment of the stabilization system mounted on a "bullpup" type rifle.
Figure 9A:
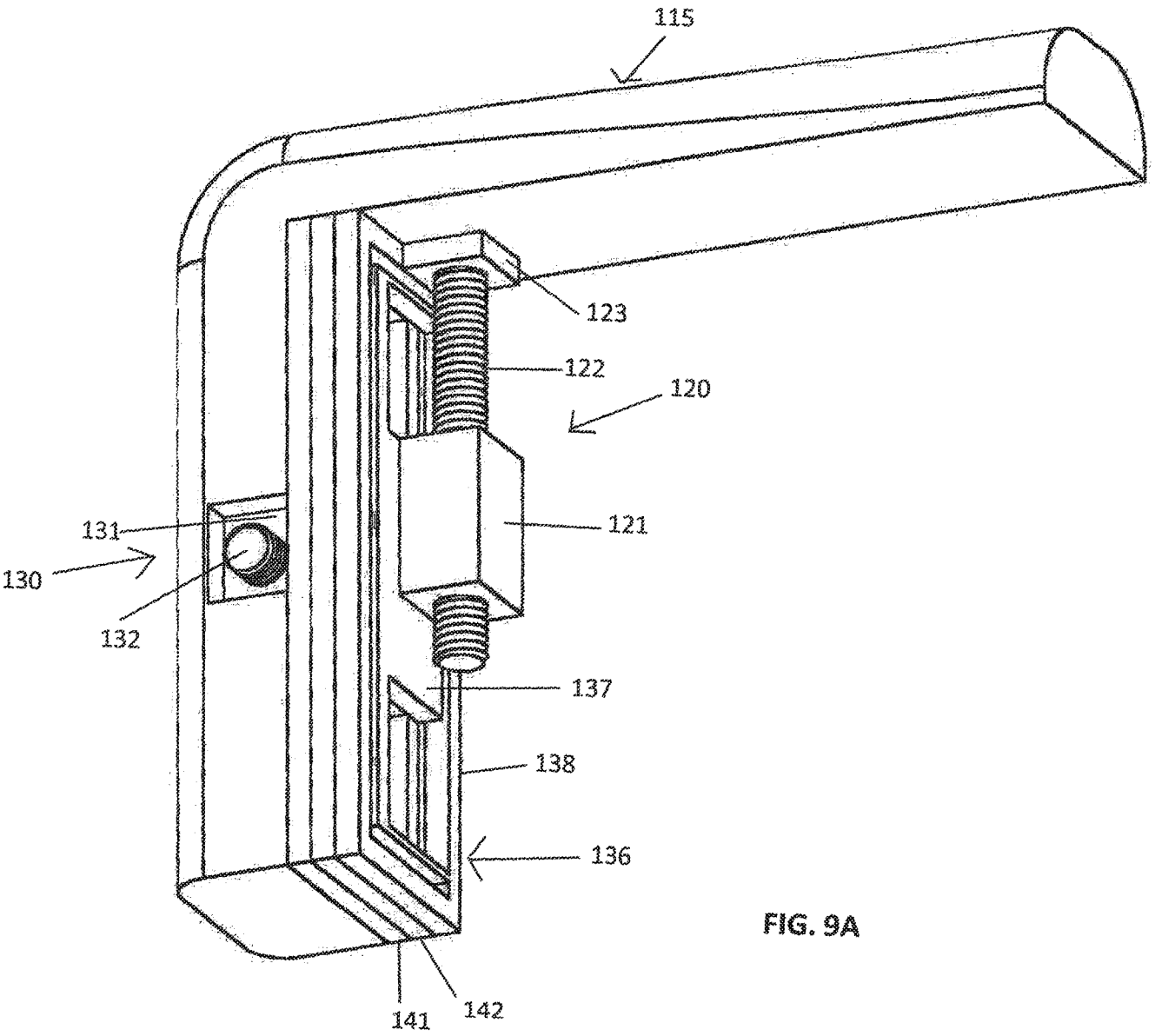
FIGS. 9A and 9B are more detailed views of the FIG. 8 stabilization system.
Figure 9B:
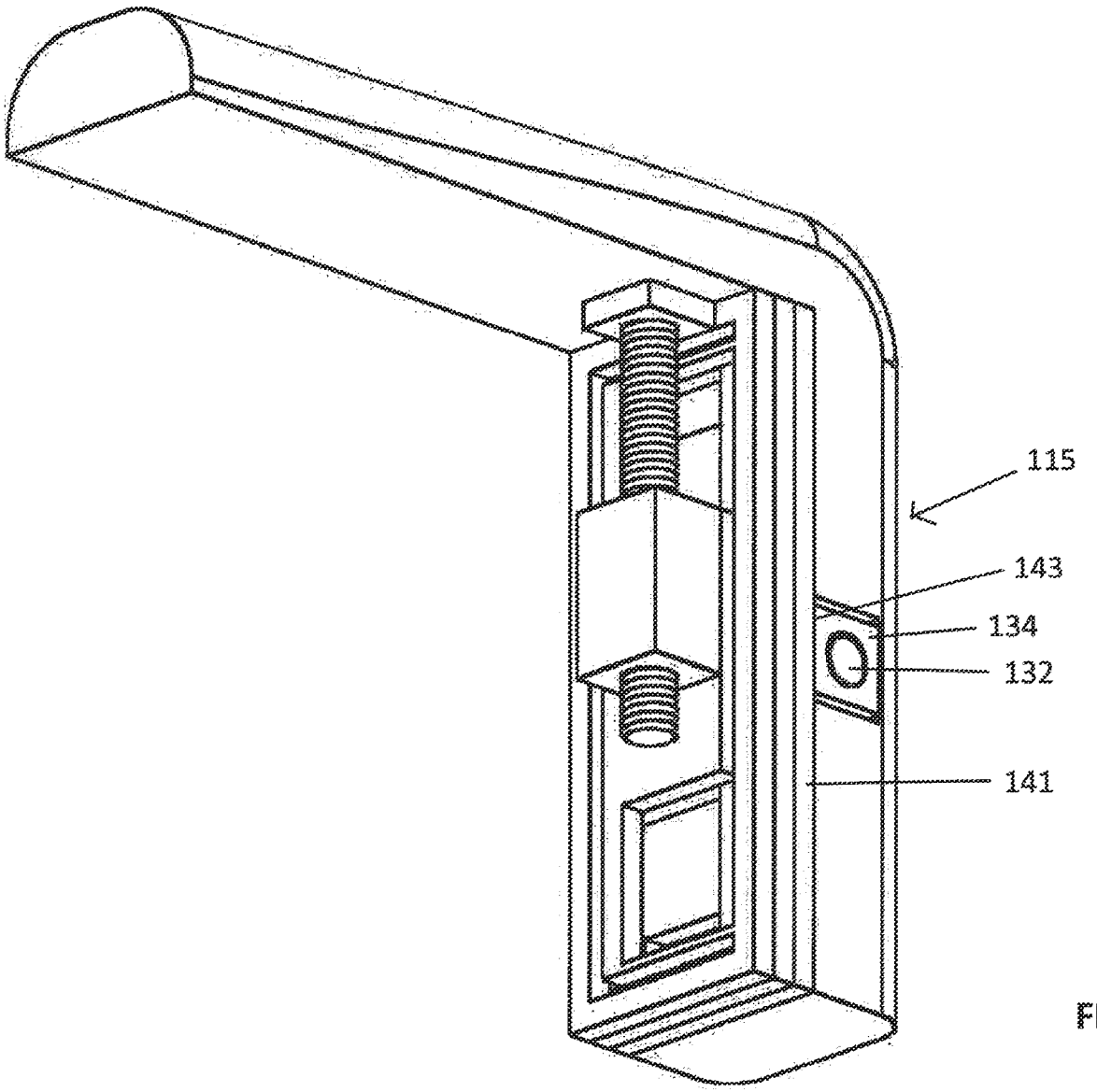
Figure 10A:
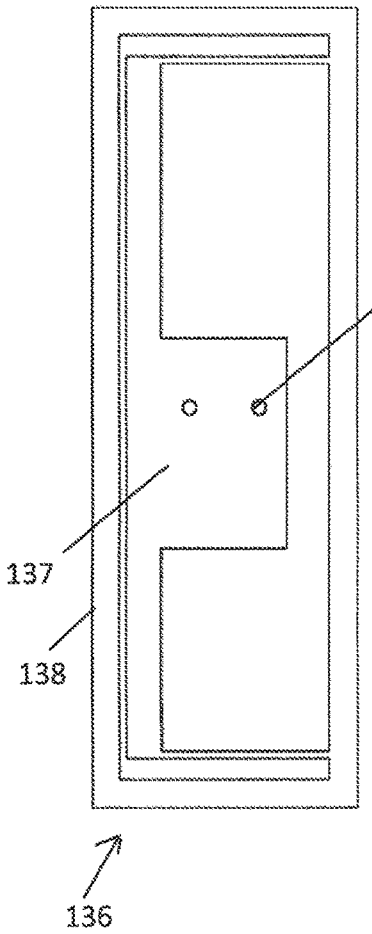
FIGS. 10A to 10C illustrate flexures employed as biasing mechanisms.
Figure 10B:
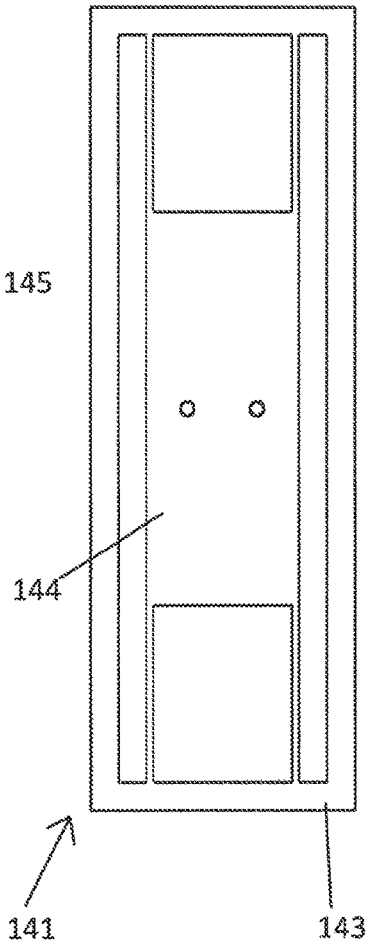
Figure 10C:
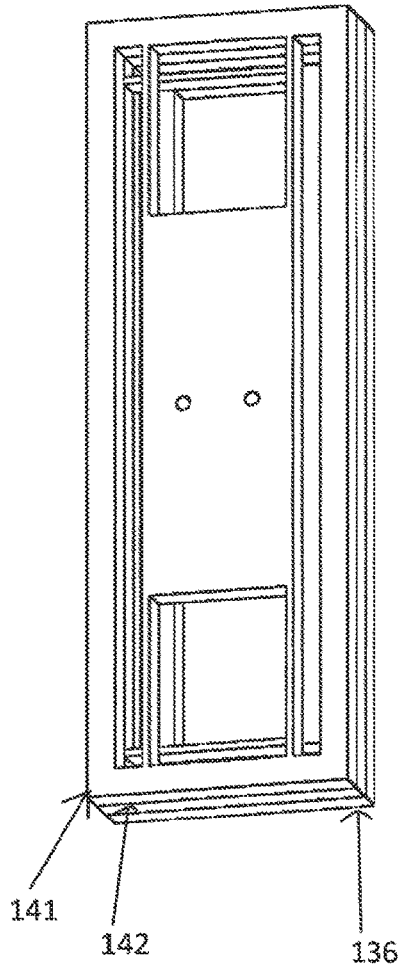

FIG. 8 illustrates one alternative embodiment of the fire arm stabilization system. FIG. 8 shows a "bullpup" rifle configuration where the action is located behind the trigger. Rather than mounting the stabilization device in conjunction with a fore grip as in FIG. 1, the stock 105 of the rifle is equipped with a shoulder/cheek plate (or "stock plate") 115. Actuators will be positioned to impart compensating movement to the stock plate 115 relative to stock 105. Of course, it will be understood that in bullpup rifle configurations, the action of the rifle generally forms the "stock" of the weapon as opposed to the more traditional stock seen in FIG. 1. FIG. 9A illustrates a vertical or elevation actuator 120 and a horizontal or windage actuator 130 interfacing with stock plate 115. Vertical actuator 120 generally comprises the ball screw motor 121 engaging the ball screw shaft 122. Vertical actuator 120 is mounted on a biasing or spring device, which in this embodiment is an assembly of flexure members such as seen in FIGS. 10A to 10C. Flexures are merely a different type of bearing which are comparatively free to move on one axis and are much stiffer on the other axes. FIG. 10A suggests a "vertical" flexure member 136 formed such that the internal element 137 is more flexible in the vertical direction within perimeter frame 138 than in the horizontal direction. Likewise, FIG. 10B shows a "horizontal" flexure member 141 formed such that the internal element 144 is more flexible in the horizontal direction within perimeter frame 143 than in the vertical direction. Both flexure members have connecting points 145 allowing the internal elements to be fixed relative to one another or some other structure. FIG. 8C illustrates a flexure assembly formed by flexure members 141, 142, and 136 connected to one another by their respective perimeter frames. Although not illustrated separately, flexure member 142 may be envisioned as the mirror image of flexure member 136. The internal elements 137 of flexure members 136 and 142 are fixed to one another, but internal element 144 is allowed to move relative to the internal elements 137.

Still viewing FIG. 9A, ball screw motor 121 is mounted on the internal element 137 of vertical flexure 136. Additionally, a connector member 123 is also fixed to the perimeter frame 138 of vertical flexure 136, with connector member 123 in turn being rigidly fixed to ball screw shaft 122 extending through screw motor 121. Thus, movement of screw shaft 122 through motor 121 will tend to move internal element 137 vertically with respect to perimeter frame 138. Although not explicitly shown in the Figures, it will be understood that the screw motor 121 will be rigidly fixed to the internal stock or action of the rifle.

In a similar manner, the horizontal actuator 130 will exert a horizontal force between the flexure assembly and stock plate 115. Ball screw motor 131 is mounted on internal element 144 of flexure member 141, while ball screw motor 131 is simultaneously fixed to stock plate 115. As suggested in FIG. 9B, a connector member 134 is rigidly fixed to the end of ball screw shaft 132 and also fixed to perimeter frame 143 of flexure member 141. It will be understood that through the above described interconnection of actuator 120, the flexure assembly, actuator 130 and stock plate 115, actuators 120 and 130 can effectuate the movement of stock plate 115 relative to the rest of the rifle.

Although not explicitly shown in the drawings, it will be understood that actuators 120 and 130 are connected to a control system such as described in reference to FIGS. 5 to 7B. The circuit board 36 (FIG. 5) with the IMU 31 could be mounted externally on the rifle stock or possibly internally if sufficient space in the action housing of the rifle model being employed. Naturally, the IMU 31 is simply one type of movement sensor which could be employed with the present invention. As one alternative to IMUs, accelerometers spaced apart along the length of the rifle could provide sufficient information to determine rates of change for both linear motion and angular motion (e.g., differential rates of change between accelerometers).

Although the above description gives examples of the stabilization mechanism interfacing with a fore grip and the stock, it will be understood that the stabilization mechanism could be positioned on any surface of the firearm which is gripped by the shooter. For purposes of this disclosure, a surface where the shooter grips or engages his/her body (e.g., cheek or shoulder) against the firearm may be referred to as a "shooter interface surface" on the firearm. Thus, shooter interface surfaces include not only the fore grip and stock of a rifle, but also the pistol grip of a rifle, the grip of a handgun, or any other surface of the firearm adapted for engagement by the shooter.

Likewise, the above disclosure describes actuators as "vertical" and "horizontal." However, the particular frame of reference is not critical. For example, if the axis along the length of the barrel is considered the "z" axis, then "vertical" and "horizontal" simply mean the two axes "x" and "y" which are perpendicular to the "z" axis, regardless of the particular rotative orientation of the "x" and "y" axes in the plane they form.

Figure 11:
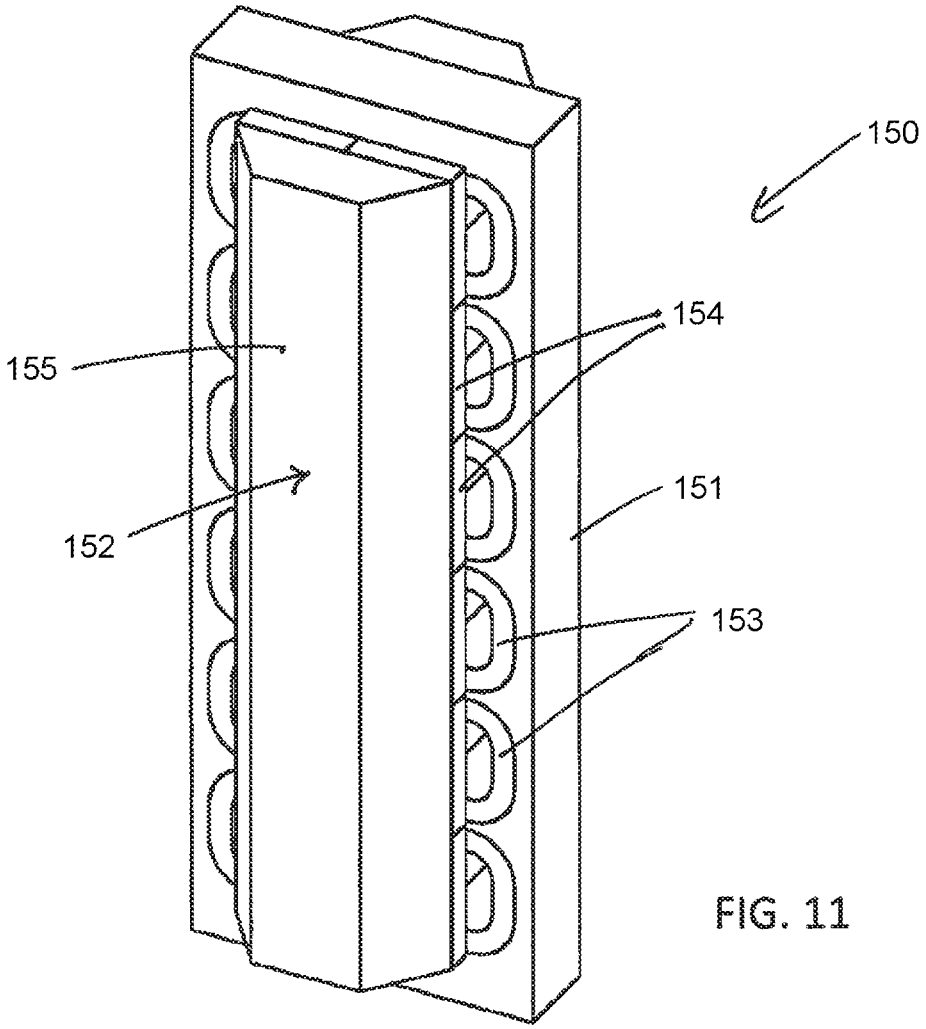
FIG. 11 illustrates another alternative actuator mechanism.

FIG. 11 illustrates a further alternative actuator embodiment. A linear actuator 150 would be constructed, consisting of a stator 151 and rotor 152 that is capable of motion on two axes, corresponding to windage and elevation. The stator 151 may be an air or steel core device consisting of an arrangement of wire coils 153 that carry current which interacts with the fields produced by the rotor 152. The rotor 152 nominally contains permanent magnets 154 mounted on rotor backiron 155. In a preferred embodiment, the stator 151 would be rigidly affixed to the rifle barrel assembly, and the rotor backiron 155 would be affixed to the fore-grip held by the user. A bearing or flexure assembly would connect the two, restricting motion to the x and y directions. By directing voltage to selected coils 153, the controller could control the relative position of the stator 151 and rotor 152 in response to sensor data as described above.

No special definition of a term or phrase, i.e., a definition that is different from the ordinary and customary meaning as understood by those skilled in the art, is intended to be implied by consistent usage of the term or phrase herein. The words and phrases used herein should be understood and interpreted to have a meaning consistent with the understanding of those words and phrases by those skilled in the relevant art. For example, an embodiment comprising a singular element does not disclaim plural embodiments; i.e., the indefinite articles "a" and "an" carry either a singular or plural meaning and a later reference to the same element reflects the same potential plurality. A structural element that is embodied by a single component or unitary structure may be composed of multiple components. Ordinal designations (first, second, third, etc.) merely serve as a shorthand reference for different components and do not denote any sequential, spatial, or positional relationship between them. Words of approximation such as "about," "approximately," or "substantially" refer to a condition or measurement that, when so modified, is understood to not necessarily be absolute or perfect but would be considered close enough by those of ordinary skill in the art to warrant designating the condition as being present or the measurement being satisfied. For example, a numerical value or measurement that is modified by a word of approximation may vary from the stated value by 1, 2, 3, 4, 5, 6, 7, 10, 12, and up to 15%.

The invention claimed is:

1. A stabilization system comprising:

a stabilization assembly including
at least one movement sensor, and
at least two actuators;

a support member connected to the stabilization assembly and configured to be supported by an operator; and a connection member connected to the stabilization assembly and configured to be connected at a first connection point to a device, wherein the device is further configured to be supported by the operator at a second support point, wherein the stabilization assembly is configured to receive at least one sensor signal from the at least one movement sensor, and output at least one actuator signal to at least one of the two actuators to provide compensation motion to the support member, the compensation motion configured to compensate for operator movement provided to the support member and within a plane orthogonal to a line between the first connection point and the second support point.

2. The stabilization system of claim 1, wherein the device is a portable weapon comprising:

a stock assembly including the second support point at a distal end of the stock assembly;

a hand guard including an accessory rail to which the connection member is configured to be fixedly attached; and a barrel substantially co-linear with a line between the first connection point and the second support point.

3. The stabilization system of claim 2, wherein the at least one of the two actuators provides the compensation motion to the support member resulting in transferring a first substantially linear motion to the barrel.

4. The stabilization system of claim 3, wherein the other of the two actuators provides a second compensation motion to the support member resulting in transferring a second substantially linear motion to the barrel in a direction orthogonal to the first substantially linear motion.

5. The stabilization system of claim 2, wherein the first connection point to the device is defined by the connection of the connection member to the accessory rail of the portable weapon.

6. The stabilization system of claim 2, wherein the hand guard is configured to surround a forward portion of the barrel.

7. The stabilization system of claim 1, wherein the at least one movement sensor comprises an inertial measurement unit (IMU) comprising:

two accelerometers measuring inertial acceleration in directions of two orthogonal axes, respectively; and two gyroscopes measuring rotational position in the directions of the two orthogonal axes, respectively.

8. The stabilization system of claim 7, wherein the at least two actuators provide the compensation motion in the directions of the two orthogonal axes, respectively.

9. The stabilization system of claim 1, wherein the operator movement of the support member in the plane orthogonal to the line defined between the first connection point and the second support point is unintended operator movement of the support member.

10. The stabilization system of claim 1, wherein the stabilization assembly further includes:

a controller configured to receive the at least one sensor signal from the at least one movement sensor, and output the at least one actuator signal to the at least one of the two actuators.

11. The stabilization system of claim 10, wherein the controller is configured to control the compensation motion to the support member to compensate for operator movement of the support member in a frequency range of 0.1 to 5 Hz.

12. The stabilization system of claim 10, wherein the controller is configured to control the compensation motion to the support member to compensate for operator movement of the support member in a frequency range of 0.5 to 3 Hz.

13. The stabilization system of claim 10, wherein the controller utilizes a proportional integral derivative algorithm to provide the compensation motion to the support member.

14. The stabilization system of claim 10, wherein the controller is configured to provide the compensation motion by adjusting a position of a barrel of a portable weapon relative to the support member.

15. The stabilization system of claim 14, wherein the controller is configured to provide the compensation motion by adjusting the position of the barrel of the portable weapon relative to the support member in at least two orthogonal directions in the plane orthogonal to the line between the first connection point and the second support point.

16. A stabilization system comprising:

a stabilization assembly including movement sensor configured to sense inertial acceleration and rotational position in two orthogonally disposed directions, and an actuator assembly for providing compensation motion in each of the two orthogonally disposed directions;

a support member connected to the stabilization assembly; and a connection member connected to the stabilization assembly and configured to be connected at a first connection point to a device, wherein the device is further configured to be supported at a second support point, wherein the stabilization assembly is configured to receive at least one sensor signal from the movement sensor, and output at least one actuator signal to the actuator assembly to provide compensation motion to the support member, the compensation motion configured to compensate for movement to the support member and be confined to a plane orthogonal to a line between the first connection point and the second support point.

17. The stabilization system of claim 16, wherein the support member is further configured to be supported an operator.

18. The stabilization system of claim 17, wherein the connection member is further configured to be supported by the operator at the second support point.

19. The stabilization system of claim 17, wherein the compensation motion is further configured to compensate for operator movement provided to the support member.

20. A stabilization system comprising:

a stabilization assembly including a movement sensor configured to sense inertial acceleration and rotational position, and an actuator assembly for providing compensation motion relative to movement sensed by the movement sensor;

a support member connected to the stabilization assembly; and a connection member connected to the stabilization assembly and configured to be connected at a first connection point to a device, wherein the device is further configured to be supported at a second support point, wherein the stabilization assembly is configured to output, based on receiving the movement sensed by the movement sensor, at least one actuator signal to the actuator assembly to provide the compensation motion to the support member, the compensation motion configured to compensate for movement provided to the support member and be confined to a plane orthogonal to a line between the first connection point and the second support point.

21. A stabilization assembly for stabilizing movement of a device, the stabilization assembly comprising:

a movement sensor;

at least two actuators;

a connection member configured to connect in a removable manner the stabilization assembly to a device at a first support point, wherein the device is configured to be supported by an operator at a second support point; and a controller configured to:

receive a sensor signal from the movement sensor, and output at least one actuator signal to at least one of the two actuators to cause the at least one of the two actuators to provide motion to compensate for operator movement of the device within a plane orthogonal to a line between the first connection point and the second support point.

* * * * *